United States Patent [19]

Reed et al.

[11] 4,204,618

[45] May 27, 1980

[54] DISPENSER FOR ROLL OF TICKET TAPES AND THE LIKE

[75] Inventors: Steven P. Reed, Felton; Jordan A. Kinkead, Atherton, both of Calif.

[73] Assignee: Sven Tveter, Saratoga, Calif.

[21] Appl. No.: 922,563

[22] Filed: Jul. 7, 1978

[51] Int. Cl.[2] ..... B26F 3/02

[52] U.S. Cl. ..... 225/106; 225/13; 225/41; 225/52

[58] Field of Search ..... 225/106, 41, 42, 43, 225/50–53, 90, 13

[56] References Cited

U.S. PATENT DOCUMENTS

| | | | |
|---|---|---|---|
| 843,579 | 2/1907 | Burr et al. | 225/106 |
| 1,122,674 | 12/1914 | Winter et al. | 225/106 |
| 1,912,363 | 6/1933 | Waide | 225/106 |
| 2,319,071 | 5/1943 | Mason | 225/51 X |
| 2,580,684 | 1/1952 | Lacy et al. | 225/43 X |
| 2,668,022 | 2/1954 | Fairfield | 225/41 X |
| 2,695,208 | 11/1954 | Graham | 225/51 X |
| 2,722,387 | 11/1955 | Tuttle | 225/43 X |
| 2,978,156 | 4/1961 | Yaniello | 225/43 X |

*Primary Examiner*—Frank T. Yost
*Attorney, Agent, or Firm*—Jack M. Wiseman

[57] ABSTRACT

A dispenser for a roll of strip comprising an open top casing. A cover is pivotally mounted on the casing for closing the top thereof. Disposed within the casing is a roll of strip having transverse slits formed therein at predetermined distances along the strip. The free end of the strip to be removed from the roll of strip exits from an opening located between the casing and the cover. Extending from the casing are transversely spaced tracks that project outwardly and downwardly from the casing, and over which advances the free end of the roll of strip. Extending from the cover are outwardly and downwardly transversely spaced guides, which overlie, respectively, the transverse tracks to form passages therebetween. The free end of the strip travels through these passages. The tracks and guides are correspondingly curved to bow the free end of the roll of strip at the transverse slit advancing through the passages to open the slit. A spring mounted on the casing applies a force to retard the egress of the strip of the roll of the tape. An operator grips the free end of the roll of strip disposed between the transversely spaced tracks and guides and applies a downward force to the free end of the roll of strip. The free end of the roll of strip is torn from the roll of strip at the transverse slit exiting from the passages by virtue of the force applied to retard the egress of the roll of strip of the roll of strip, the force applied to the free end of the roll of strip by the operator, and the frangibility of the free end of the roll of strip at the opened slit.

13 Claims, 5 Drawing Figures

DISPENSER FOR ROLL OF TICKET TAPES AND THE LIKE

BACKGROUND OF THE INVENTION

The present invention relates in general to a dispenser for a roll of strip in which the free end of the roll of strip is to be removed from the roll of strip at a predetermined location.

The patent to Burr et al., U.S. Pat. No. 843,579, discloses a label dispenser for tearing off labels of the same predetermined length from a roll of labels. The roll of labels is formed with transverse slits at predetermined distances therealong. The casing is formed with a flange projecting outwardly therefrom that is curved in several directions. The cover includes a guide that overlies the flange to form a gap therebetween through which travels the free end of the roll of labels. A slot in the guide of the cover enables an operator to apply a downward force to the free end of the roll of labels. A spring in the casing applies a restraining force to the roll of labels. An operator pulling downwardly on the free end of the labels tears the free end of the label at the succeeding slit of the roll of labels by the restraining force applied to the roll of labels, the force applied at the free end of the labels, and the concentration of pressure applied to the roll of labels at the succeeding transverse slit by the curved flange.

Heretofore, dispensers for rolls of ticket tape have been employed in which a roll of ticket tape was disposed in the casing. A pivotally mounted cover closed the open top of the casing. The casing was formed with a flange over which the free end of the ticket tape advanced. The ticket tape was formed with tongues or flaps defining openings in the tape at predetermined distances therealong. By pulling downwardly on the tongue at the free end of the ticket tape, the tongue of the succeeding ticket to be removed would advance over the flange and the transverse edges of the exiting ticket adjacent the tongue of the succeeding ticket would be severed to remove the free end of the ticket tape from the remaining roll of tickets. Such a product was sold by AB Turn-O-Matic of Stockholm, Sweden, as the "Turn-O-Matic" dispenser.

S G T Enterprises of Santa Clara, California, sold a "Take-A-Turn" ticket dispenser in which the ticket tape had tongues or flaps at predetermined distances therealong defining openings in the ticket tape. An indexing flange projected outwardly from the casing. The tongue of the succeeding ticket to be removed advanced over the flange. The cover was formed with two depending tabs and a depending wall at the ticket exit. As the free end of the ticket tape was pulled by an operator, the tongue of the succeeding ticket to be removed bunched up to wedge between the depending tabs and the depending wall of the cover to restrain the movement of the roll of ticket tape. An operator applied a downward force on the tongue at the free end of the ticket tape. This action tore the free end of the ticket tape from the remainder of the roll at the opening defined by the tongue of the succeeding ticket to be removed from the roll of tape. This result was achieved by the restraining force applied to the roll of ticket tape through the depending tabs and the depending wall; the downward force applied by the operator to the tongue at the free end of the ticket tape; and the frangibility of the roll of ticket tape at the opening defined by the tongue of the succeeding ticket to be removed.

In the patent to Ehrlund, U.S. Pat. No. 3,885,724, there is disclosed a ticket dispenser having a casing with an open top. A cover is pivotally attached to the casing to close the opened top of the casing. A roll of ticket tape is disposed in the casing. The ticket tape is formed with tongues or flaps defining openings in the roll of ticket tape at predetermined distances therealong. A flange projects outwardly from the casing over which advances the tongue of the exiting free end of the roll of tape. On each side of the flange, the casing includes knife edges. An operator pulls downwardly on the tongue at the free end of the ticket tape. As the tongue of the succeeding ticket to be severed advances over the flange, the knife edges cut the ticket tape transversely at the opening defined by the tongue of the succeeding ticket to be removed.

In the patent to Ingram, U.S. Pat. No. 1,704,044, there is disclosed a dispenser for severing tickets from a roll of strip of predetermined lengths. The roll of strip is formed with transverse slits at predetermined distances therealong. The cover is formed with a flange which registers with the transverse slits for indexing the length of the strip to be removed from the dispensers. Knife edges on both sides of the flange sever the free end of the strip when the operator applies a force to the free end of the strip. A tension spring maintains the free end of the strip against the flange and the knife edges. A slot is formed in the cover to grip the free end of the strip.

The patent to Osborne, U.S. Pat. No. 3,229,876, discloses a dispenser for a roll of film. Perforations are formed transversely across the film at predetermined distances along the roll of film. The case of the dispenser includes an arresting tab which penetrates the perforation following the strip to be removed from the roll of film. The arresting tab restrains rotation of the roll of film upon penetrating a perforation. An operator applying a force to the free end of the roll of film tears a strip from the roll of film along the transverse perforation.

The patent to Storm, U.S. Pat. No. 1,239,981, discloses a ticket dispenser in which projections engage notches of a ticket strip to index the strip at a tearing edge. The free end of the strip is severed by a knife edge.

SUMMARY OF THE INVENTION

A dispenser for a roll of strip to remove successively pieces of strip of predetermined lengths from the roll of strip. The roll of strip is formed with slits spaced therealong. The dispenser comprises a container in which is disposed the roll of strip. Projecting from the container at the strip exiting opening thereof are transversely spaced paths over which advances the free end of the strip to be removed from the roll of strip. Means retard the egress of the free end of the roll of strip, while an operator pulls on the free end of the strip. The transversely spaced paths are formed with a curved configuration to open the slit as an operator pulls on the free end of the roll strip. The free end of the strip is removed from the roll of strip at the opened slit through the retarding of the egress of the free end of the roll of strip, the force applied to the free end of the strip by an operator, and the frangibility of the roll of strip at the opened slit.

A feature of the present invention is that the casing, in which the roll of strip is disposed, has extending therefrom outwardly projecting, transversely spaced tracks over which the free end of the roll of strip travels. The cover, which is pivotally attached to the casing, has extending therefrom outwardly projecting, transversely spaced guides. The outwardly projecting transversely spaced guides extending from the cover overlie respectively the outwardly projecting, transversely spaced tracks extending from the casing to form respective passages therebetween through which the free end of the roll of strip advances. Thus, the free end of the roll of strip can be threaded with facility and ease of operation. Additionally, the space between the overlying transversely spaced tracks and guides enable an operator to grip the free end of the tape with facility and ease of operation.

By virtue of the present invention, a roll of strip economical to manufacture can be employed, since flaps and tongues have been obviated. In addition, the present invention reduces cost of operation by restraining the roll of strip from excessive rotation while the free end of the strip is being removed. Another feature of the present invention is the self-locking arrangement between the cover and the casing. By avoiding the use of a latch between the cover and the casing, there is a reduced loss of strip resulting from the inadvertent failure to latch the cover to the casing.

In the preferred embodiment, the cover is transparent and the roll of strip feeds from the top so that the advancing free end of the roll of strip is visible to be read by an operator.

Another feature of the present invention is a spring for retarding the egress of the roll of strip while the free end of the roll of strip is being moved, which spring not only applies a constant force, but also gives the cover a pop-up action when the cover is to be displaced from the closed position.

DESCRIPTION OF THE PREFERRED ENBODIMENT

Figure 1:
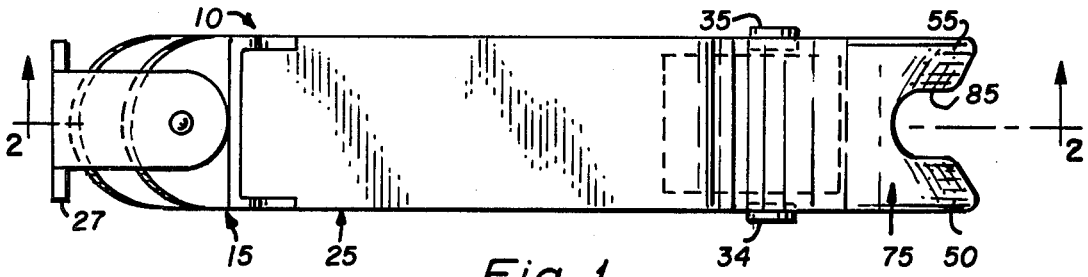
FIG. 1 is a top view of a dispenser embodying the present invention.

Illustrated in FIGS. 1-4 is a dispenser 10 embodying the present invention. The dispenser 10 comprises a suitable container or housing 15 for a roll of flexible strip R, such as ticket tapes, labels, paper strips and the like. In the preferred embodiment, the strip housing comprises a casing 20 and a cover 25 pivotally connected to the casing by a suitable hinge 26. The top of the casing 20 is opened (FIG. 4) and when the cover 25 is retracted, the roll of strip R can be placed in or removed from the casing 20. The cover 25 is preferably transparent so that the free end of the roll of strip R is visible for reading by an operator. A suitable bracket 27 is integrally formed at the rear of the casing 20 to enable the dispenser 10 to be mounted on a suitable support or stand.

At the forward upper portion of the casing 10 are formed transversely aligned, confronting cylindrical openings 30 and 31. Depending from the cover 25 are transversely spaced leaf springs 32 and 33. Fixed to the lower extremities of the leaf springs 32 and 33 are annular locking tabs 34 and 35. The leaf springs and tabs may be formed of the same material from which the cover is formed and may be integrally formed therewith. In the preferred embodiment, the cover and casing are made from a molded plastic. When the cover 25 is in the fully closed position on the casing 10 (FIGS. 2 and 3), the tabs 34 and 35 are disposed in the openings 30 and 31, respectively. The leaf springs continuously urge the tabs 34 and 35 into the openings 30 and 31, respectively, to automatically lock the cover 25 in the closed position and to maintain the cover 25 in the locked position. To lift the cover 25 to the retracted position (FIG. 4), the tabs 34 and 35 are manually urged inwardly against the urgency of the leaf springs 32 and 33 until removed from the openings 30 and 31. Thereupon, the cover 25 is pivoted to a fully retracted position for the insertion or removal of the roll of strip R from the container 15.

Projecting outwardly and downwardly from the casing 20 are transversely spaced tracks 40 and 45. Projecting outwardly and downwardly from the cover 25 are transversely spaced guides 50 and 55 that overlie, respectively, the tracks 40 and 45 to define passages 60 and 65 through which the free end of the roll of strip advances. The tracks 40 and 45 are interconnected at the distal end thereof to form an inverted U-shaped member 70 on which the free end of the roll of strip advances. Similarly, the guides 50 and 55 are interconnected at the distal end thereof to form an inverted U-shaped member 75 that overlies the U-shaped member 70 to define the existing passage for the free end of the roll of strip. The U-shaped members 70 and 75 project outwardly and downwardly.

Formed on an inner front wall 20*a* of the casing 20 by a confronting wall 20*b* is a pocket 76. Inserted in the pocket 76 is a leaf spring 80. The leaf spring 80 includes a depending portion which is insertable in the pocket 76 and an arcuate, angular portion which engages the free end of the roll of strip for applying a constant and continuous force to the underside of the roll of strip R. The leaf spring 80 (FIG. 2) continuously urges the strip of the roll of strip R against the underside of the cover 25 at the location of the proximal end of the U-shaped member 75. The leaf spring 80 also provides a pop-up action to the cover 25 when the tabs 34 and 35 are released from the openings 30 and 31 for opening the top of the dispenser 10.

Figure 2:
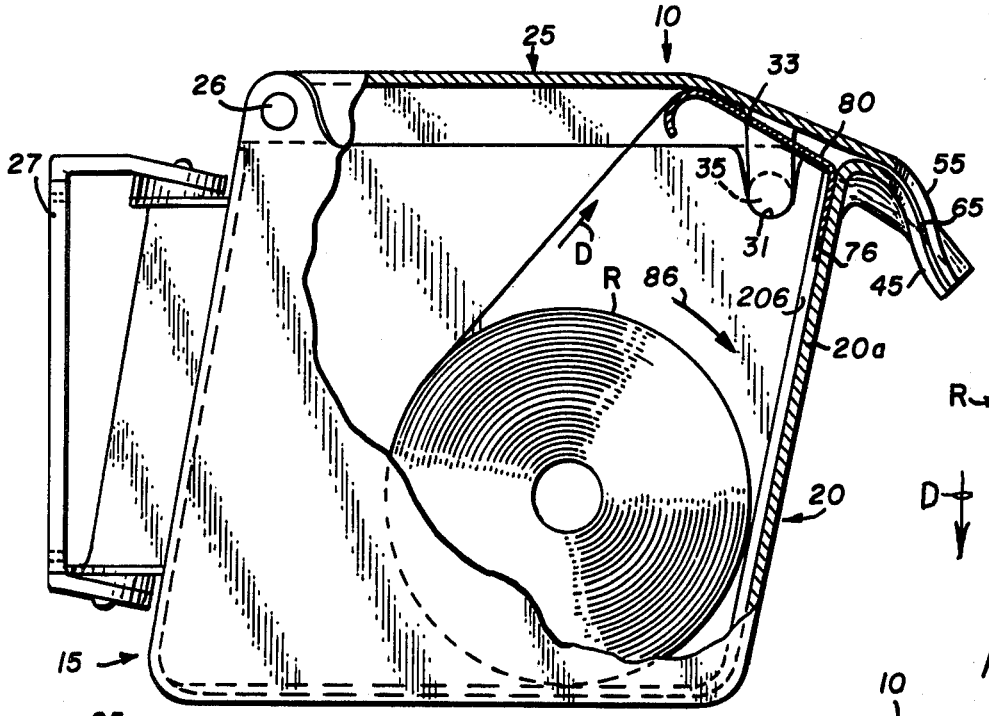
FIG. 2 is a vertical section view of the dispenser shown in FIG. 1 taken along line 2—2 of FIG. 1 and illustrated with a roll of flexible strip disposed therein.
Figure 3:
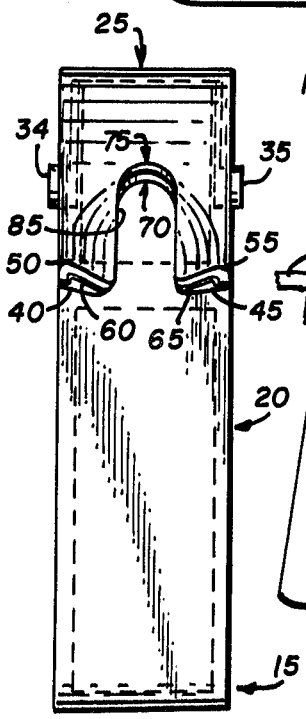
FIG. 3 is a front elevation view of the dispenser shown in FIGS. 1 and 2.
Figure 4:
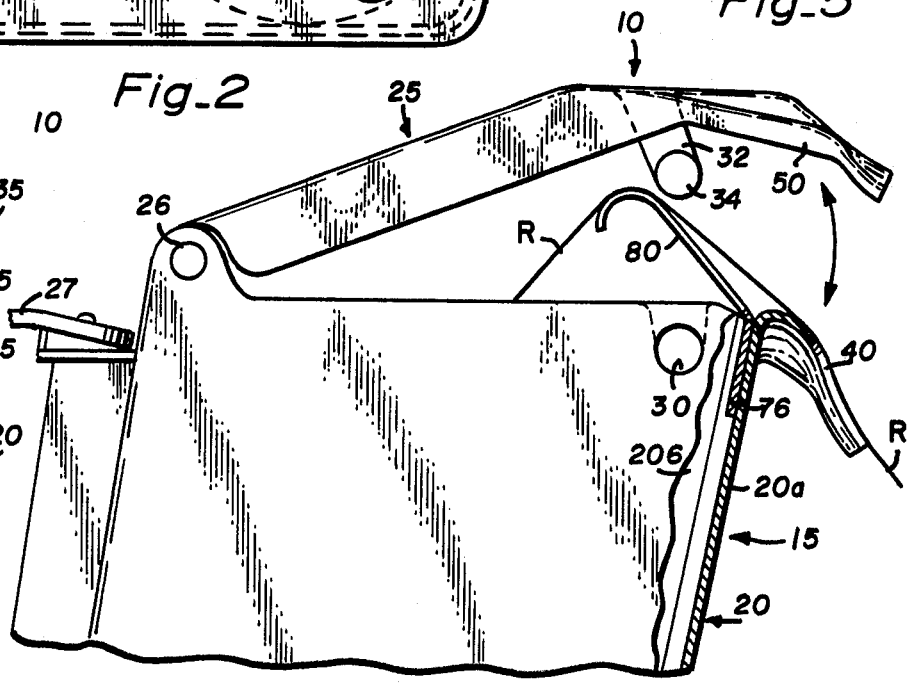
FIG. 4 is a side elevation view of the dispenser shown in FIGS. 1-3 with the cover thereof shown in a retracted position.

The tracks 40 and 45, the guides 50 and 55, and the passages 60 and 65 are curved in the transverse direction and in the longitudinal direction (FIGS. 2 and 3). The transverse curves are directed inwardly and downwardly. The longitudinal curves are directed downwardly. Thus, the tracks 40 and 45, the guides 50 and 55, and the passages 60 and 65 have curved, twisted configurations. A slot 85 is formed between the transversely spaced tracks 40 and 45, the transversely spaced guides 50 and 55, and the transversely spaced passages 60 and 65. An operator can insert his fingers in the slot 85 to grip the free end of the roll of strip.

In the operation of the dispenser 10, the cover 25 is fully retracted. A roll of strip R is placed in the casing 20 with the free end of the roll of strip R feeding from the clockwise direction as viewed in FIG. 2 and shown by the arrow 86. As the free end of the roll of strip R is advanced by the force applied thereto by an operator, the roll of strip R feeds from the top and rotates in the clockwise direction as shown in FIG. 2. The free end of the roll of strip R is threaded over the leaf spring 80, and over the U-shaped member 70 with the extreme end overlying the slot 85.

Now, the cover 25 is closed (FIG. 2) and the tabs 34 and 35 are seated in the openings 30 and 31 to lock the cover 25 in the closed position. To remove the free end of the roll of strip R, an operator pulls downwardly on the free end of the roll of strip in the direction of the arrow D shown in FIG. 5 to advance the free end of the roll of strip R through the passages 60 and 65. As the free end of the roll of strip R advances and the transverse slit $S_1$ advances in the passages 60 and 65, the curved tracks 40 and 45, and the curved guides 50 and 55 bow the advancing free end of the roll of strip trailing the slit $S_1$ upwardly, and bow the free end of the roll of strip R leading the slit $S_1$ downwardly.

The slit $S_1$ advancing through the passages 60 and 65 in the direction of the arrow D (FIG. 2) opens with a substantially ovate configuration. The leaf spring applies a force to the engaged strip of the roll of strip R. When the slit $S_1$ is opened to a bowed configuration as above-described, an operator applying a continuous force to the free end of the roll of strip R will tear the free end of the roll of strip R from the remainder of the roll of strip R at the opened transverse slit $S_1$ of the roll of strip R, while the spring 80 retards the egress of the strip of the roll of strip R from the housing 15 through the force applied thereto. When the free end of the roll of strip R is removed from the roll of strip R, the opened slit $S_1$, which is where the tearing action occurred, is located in the vicinity of the distal ends of the tracks 40 and 45 and the guides 50 and 55.

Thus, the free end of the roll of strip is removed at a predetermined location (slit $S_1$) when an operator applies a downward force to the free end of the roll of strip R. The tearing action occurs at the transverse slit $S_1$, when opened, by virtue of the frangibility of the roll of strip at an opened transverse slit. The restraining force applied by the spring 80 is sufficient to hold back the roll of strip R while the transverse slit $S_1$ is opened, but insufficient to preclude the rotation of the roll of strip when the transverse slit $S_1$ is closed and an operator applies a force to the free end of the roll of strip R.

Figure 5:
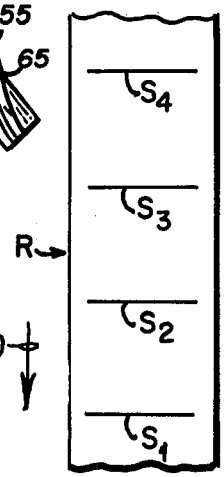
FIG. 5 is a fragmentary plan view of a roll of strip having transverse slits usable with the dispenser shown in FIGS. 1-4.

After the strip at the free end of the roll of strip R is torn in the manner above-described, the succeeding free end of the roll of strip occupies the slot 85. The operator pulls on the free end of the roll of strip disposed in the slot 85, and the above operation is repeated with the free end of the roll of strip being torn along the slit $S_2$ (FIG. 5).

When the roll of strip R is of a relatively fragile paper, the tracks 40 and 45 and the guides 50 and 55 along the downward curvature thereof provide a sufficient restraining force to the roll of strip so that the need of the restraining force applied by the spring 80 has been obviated while the free end of the roll of strip R is removed from the roll of strip R. On occasions, the roll of strip R may provide a sufficient inertia for the application of a restraining force.

While the preferred embodiment shows a transverse slit, it is to be understood that other configurations of transverse openings may be employed equally as well.

We claim:

1. A dispenser for tearing strips from a roll of flexible strip with slits at predetermined locations therealong comprising:

(a) a container for housing a roll of strip, and container being formed with an exit opening through which the free end of the roll of strip advances from the container;

(b) means in said container engaging strip of said roll of strip for applying a force to retard the the egress of the strip from said container;

(c) transversely spaced curved twisted tracks projecting from said container over which the free end of the roll of strip advances; and (d) transversely spaced curved twisted guides projecting from said container in overlying relation to said tracks respectively to form transversely spaced curved twisted passages therebetween through which the free end of said roll of strip advances, said curved twisted tracks and said curved twisted guides being arranged to open a slit of said roll of strip while said slit is advancing through said passages by bowing the free end of the strip advancing therebetween at the slit, whereby the free end of the roll of strip is torn from the roll of strip at the opened slit through the application of force applied to the free end thereof, the application of the retading force applied by said means and the frangibility of the free end of the roll of strip at the opened slit.

2. A dispenser as claimed in claim 1 wherein said transversely curved tracks and said transversely curved guides project in a downward direction.

3. A dispenser as claimed in claim 2 wherein said container comprises a casing with an open top for disposing the roll of strip therein, and a cover pivotally connected to said casing for closing the top thereof and pivotal to a retracted position for the insertion and removal of the roll of strip in said casing, said transversely spaced tracks extending from said casing to project therefrom, said transversely spaced guides extending from said cover to project therefrom and being arranged to overlie said transversely spaced tracks to form said transversely spaced passages through which the free end of the roll of strip advances.

4. A dispenser as claimed in claim 3 and comprising interlocking means interlocking said casing and said cover adjacent to said transversely spaced tracks and said transversely spaced guides for interlocking said cover and said casing.

5. A dispenser as claimed in claim 4 wherein said interlocking means comprises transversely spaced leaf springs depending from said cover adjacent said transversely spaced guides and extending into said casing when said cover closes the top of said casing, a tab fixed to the free end of each of said leaf springs, and transversely spaced walls formed in said casing having transversely spaced openings formed therein adjacent said transversely spaced tracks to receive said tabs, respectively, for interlocking said cover and said casing.

6. A dispenser as claimed in claim 5 wherein said means comprises a leaf spring mounted on said casing adjacent said interlocking means and projecting toward said cover, the free end of the roll of strip advancing over said leaf spring into the exit opening, said leaf spring applying a retarding force to the egress of the free end of the roll of strip from the container.

7. A dispenser as claimed in claim 4 wherein said means comprises a leaf spring disposed adjacent to said interlocking means and over which the free end of the roll of strip advances into the exit opening for applying a retarding force to the egress of the free end of the roll of strip from the container.

8. A dispenser as claimed in claim 3 wherein said cover is transparent for observing the free end of the roll of strip disposed therebelow.

9. A dispenser for tearing strips from a roll of flexible strip with slits at predetermined locations therealong comprising:

(a) a container for housing a roll of strip, said container being formed with an exit opening through which the free end of the roll of strip advances from the container;

(b) transversely spaced curved twisted tracks projecting from said container over which the free end of the roll of strip advances; and (c) transversely spaced curved twisted guides projecting from said container in overlying relation to said tracks respectively to form transversely spaced curved twisted passages therebetween through which the free end of said roll of strip advances, said curved twisted tracks and said curved twisted guides being arranged to retard the egress of the free end of the roll of strip and to open the slit of said roll of strip while said slit is advancing through said passages by bowing the free end of the strip advancing therebetween at the slit, whereby the free end of the roll of strip is torn from the roll of strip at the opened slit through the application of force applied to the free end thereof, the retarding of the egress of the free end of the roll of strip, and the frangibility of the free end of the roll of strip at the opened slit.

10. A dispenser as claimed in claim 9 wherein said transversely curved tracks and said transversely curved guides project in a downward direction.

11. A dispenser as claimed in claim 10 wherein said container comprises a casing with an open top for disposing the roll of strip therein, and a cover pivotally connected to said casing for closing the top thereof and pivotal to a retracted position for the insertion and removal of the roll of strip in said casing, said transversely spaced tracks extending from said casing to project therefrom, said transversely spaced guides extending from said cover to project therefrom and being arranged to overlie said transversely spaced tracks to form said transversely spaced passages through which the free end of the roll of strip advances.

12. A dispenser as claimed in claim 11 and comprising interlocking means interconnecting said casing and said cover adjacent to said transversely spaced tracks and said transversely spaced guides for interlocking said cover and said casing.

13. A dispenser as claimed in claim 12 wherein said interlocking means comprises transversely spaced leaf springs depending from said cover adjacent and transversely spaced guides and extending into said casing when said cover closes the top of said casing, a tab fixed to the free end of each of said leaf springs, and transversely spaced walls formed in said casing having transversely spaced openings formed therein adjacent said transversely spaced tracks to receive said tabs, respectively, for interlocking said cover and said casing.

* * * * *